US005513965A

United States Patent [19]

Nakamura et al.

[11] Patent Number: 5,513,965

[45] Date of Patent: May 7, 1996

[54] DISTRIBUTOR-TYPE FUEL INJECTION PUMP

[75] Inventors: Hisashi Nakamura; Kenichi Kubo; Jun Matsubara, all of Higashimatsuyama, Japan

[73] Assignee: Zexel Corporation, Tokyo, Japan

[21] Appl. No.: 445,209

[22] Filed: May 18, 1995

[30] Foreign Application Priority Data

May 19, 1994 [JP] Japan ..... 6-129616

[51] Int. Cl.[6] ..... F02M 39/00

[52] U.S. Cl. ..... 417/462; 123/450

[58] Field of Search ..... 417/462, 440; 123/450

[56] References Cited

U.S. PATENT DOCUMENTS 2,674,236 4/1954 Humber .
3,311,100 3/1967 Maddalozzo .
4,376,432 3/1983 Davis ..... 417/462 X
4,562,815 1/1986 Takano et al. ..... 417/462 X
4,662,337 5/1987 Eheim ..... 123/450
4,699,108 10/1987 Rouse et al. ..... 123/450

*Primary Examiner*—Richard E. Gluck
*Attorney, Agent, or Firm*—Wenderoth, Lind & Ponack

[57] ABSTRACT

In an innercam system fuel injection pump, plungers 15 are provided in the direction of the radius of a rotating member 10 which rotates in synchronization with the engine. A cam ring 18, which regulates the movement of the plungers, is fixed in a housing 2. A first sleeve 25 for regulating the timing with which a cutoff port 22 opens and a second sleeve 26 for regulating the timing with which an intake port 21 opens are externally fitted on the rotating member 10 in such a manner that they can slide freely. The first sleeve 25 and the second sleeve 26 interlock with each other in a specific relationship and a timer mechanism 40, which is directly linked to the second sleeve 26, controls the quantity of rotation of the second sleeve 26. With this, stable injection timing control can be achieved.

7 Claims, 5 Drawing Sheets

DISTRIBUTOR-TYPE FUEL INJECTION PUMP

BACKGROUND OF THE INVENTION

1. Field of the Invention

The present invention relates to a distributor-type fuel injection pump that uses an innercam system for supplying fuel to engines, including diesel engines, and specifically, to an fuel injection pump that employs a method in which plungers make a reciprocal movement in relation to a rotating member that rotates synchronously with the engine in the direction of the radius of the aforementioned rotating member.

2. Description of the Related Art

Distributor-type fuel injection pumps using the innercam system in the known art include the one disclosed in Japanese Unexamined Patent Publication No. S57-179362. In this fuel injection pump, a cam ring 54 is provided on the circumference of a rotor 20 (rotating member) concentrically, pistons 40 (plungers) are provided on the cam surface formed on the inside of the cam ring 54 via rollers 56 and roller shoes 58. The pistons 40 make a reciprocal movement in the direction of the radius of the rotor 20. During the intake process, in which the pistons 40 move toward the outside in the direction of the radius, fuel is taken into the compression space via an intake passage 34. During the force feed process, in which the piston moves toward the inside in the direction of the radius, the fuel which has been pressurized in the compression space is sent out via a fuel distribution passage. Then, during the force feed process, when the fuel is cut off from an overflow passage 62, the injection ends. The force feed timing is adjusted by linking a timing mechanism 60 (timer mechanism) to the cam ring 54 and then by causing the cam ring 54 to turn in the direction of the circumference with the timing mechanism 60.

However, when the pressure in the compression space is raised in order to use the injection pump described above for a diesel engine or the like, a reaction force, which works on the cam ring via the pistons, the rollers and the roller shoes, also increases. This, in turn, increases the lead applied in the direction of the rotation of the cam ring. Because of this, when the lead applied in the direction of the rotation of the cam ring exceeds the force with which the cam ring is driven by the timer mechanism, accurate advance angle control can no longer be performed, notwithstanding the timer adjustment, resulting in inconsistent injection timing and unstable performance. In order to solve this problem, a timer mechanism with a drive force that can overcome the lead described earlier during fuel force feed is required. However, if such a timer mechanism is to be achieved in the conventional structure, in which the timer mechanism is connected to the cam ring, the timer mechanism becomes large and complicated.

SUMMARY OF THE INVENTION

Accordingly, the main object of the present invention is to provide an innercam system, distributor-type fuel injection pump in which stable timing of fuel force feed (injection timing) can be obtained in a simple structure.

In addition to the object described above, another object of the present invention is to provide a distributor-type fuel injection pump in which the fuel injection timing and the force feed effective angle (force feed effective stroke) are controlled independently through the positional control of a sleeve which is externally fitted on the rotating member, and in which the injection timing and the force feed effective angle (force feed effective stroke) can be controlled with a high degree of precision.

The inventor of the present invention, after researching into various types of innercam-based fuel injection systems, has come to complete the present invention out of the observation that, in controlling the injection timing in the prior art, because the cam ring itself is made to rotate, it is necessary to take into consideration the drive reaction force during force feed. However, injection control could be improved if a structure were developed in which the injection timing and the injection quantity were controlled with the cam ring fixed to the pump housing.

Namely, the distributor-type fuel injection pump according to the present invention comprises a rotating member that rotates in synchronization with an engine, plungers that are provided in the direction of the radius of the rotating member, which change the volumetric capacity of a compression space that is formed in the rotating member, a cam ring that is provided concentrically to, and on the circumference of the rotating member, which regulates the movement of the plungers, all of which are provided in a housing, ports for taking in, letting out and cutting off fuel by communicating with the compression space formed at the rotating member, and a first sleeve for adjusting the timing with which the fuel cutoff port opens that is externally fitted on the rotating member in such a manner that it can slide freely. In this distributor-type fuel injection pump, the cam ring is fixed to the housing, a second sleeve for regulating the timing with which the fuel intake port is opened is externally fitted on the rotating member in such a manner that it can slide freely, a means for interlocking the first sleeve and the second sleeve in a specific relationship is provided, and the quantity of rotation of the second sleeve in the direction of the circumference is adjusted by linking a timer mechanism to the second sleeve.

The timing with which the fuel cutoff port is opened is adjusted by forming a cutoff hole which can communicate with the fuel cutoff port at the first sleeve. Preferably, the cutoff port and the cutoff hole should be formed as slits which extend in the direction of the axis of the rotating member.

The means for interlocking the first sleeve and second sleeve can be constituted by forming a diagonal lead groove in the first sleeve at a specific angle to the direction of the axis and by connecting and holding the second sleeve in the diagonal lead groove.

Consequently, according to the present invention, when the fuel inside the compression space becomes compressed by the plungers, the fuel pressure imparts a reaction force on the cam ring via the plungers. However, since the cam ring is fixed the pump housing, this does not affect the cam characteristics. Although the cam ring is fixed, since the rotating member is provided with a second sleeve that interlocks in a specific relationship with the first sleeve to control the injection timing, while the first sleeve controls the injection quantity, with the timer mechanism linked to the second sleeve, when the second sleeve is rotated with the timer, the timing with which the intake port is opened changes, and the injection timing is thereby controlled. In other words, according to the present invention, instead of moving the cam ring, the second sleeve is adjusted to shift the area over which the cam is engaged during the force feed process. Thus, the injection timing is changed by changing the pre-stroke quantity. In this case, the injection quantity can be expected to change slightly with different areas over which the cam is engaged, but basically, the injection quantity is adjusted by controlling the first sleeve.

Especially, if the cutoff port and the cutoff hole which is provided in the first sleeve are formed as slits extended in the direction of the axis of the rotating member, even when there is some play in the rotating member in the direction of the axis, it will not affect the injection timing or the force feed effective angle.

In addition, with a structure in which a diagonal lead groove is formed in a first sleeve at a specific angle to the direction of the axis to connect and hold a second sleeve, when the second sleeve is rotated with the timer, the first sleeve also rotates by the same angle. Consequently, the injection timing can be changed without changing the force feed effective angle. Furthermore, if the first sleeve is moved in the direction of the axis of the rotating member while the second sleeve is stationary, the timing with which the cutoff port is opened by the diagonal lead groove is changed, which, in turn, changes the force feed effective angle. In short, since the first sleeve and the second sleeve interlock with each other in a specific relationship, the injection timing and the force feed effective angle can be controlled independently of each other. This eliminates the necessity of considering the control of the other while performing control of one.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiment. In the drawings.

DETAILED DESCRIPTION OF THE PREFERRED EMBODIMENT

The following is a explanation of an embodiment of the present invention in reference to the drawings.

Figure 1:
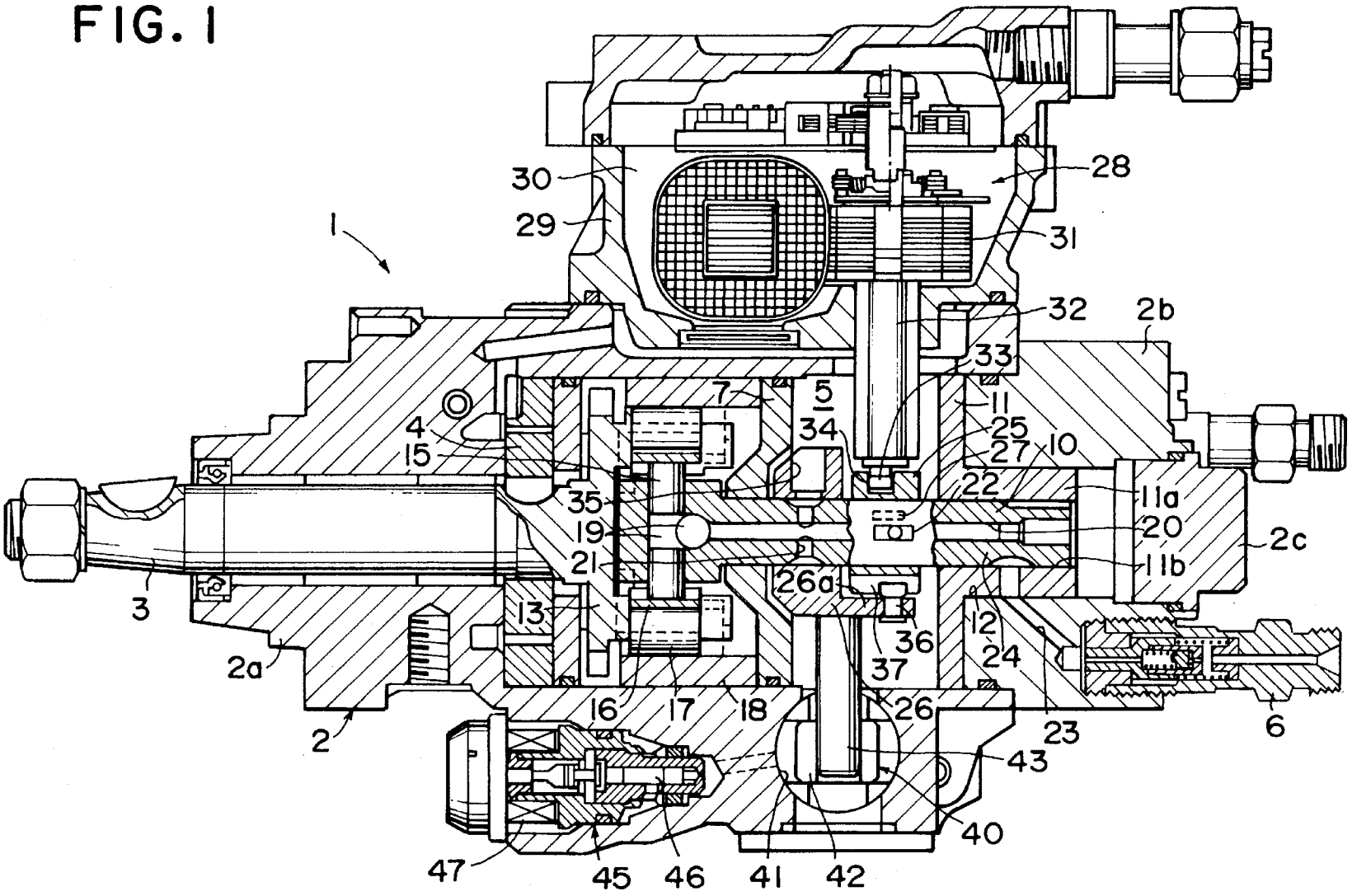
FIG. 1 is a cross section of the distributor-type fuel injection pump according to the present invention.

FIG. 1 shows an innercam system, distributor-type fuel injection pump. In the distributor-type fuel injection pump 1, a drive shaft 3 is inserted in a pump housing 2. One end of the drive shaft 3 projects out to the outside of the pump housing 3 to receive drive torque from the an engine (not shown) so that it can rotate synchronously with the engine. The other end of the drive shaft 3 extends into the pump housing 2. A feed pump 4 is linked to the drive shaft 3 and through this feed pump 4, fuel which is supplied from the outside via a fuel intake port (not shown) is supplied to a chamber 5.

The pump housing 2 comprises a housing member 2*a* through which the drive shaft 3 passes, a housing member 2*b*, which is mounted on the housing member 2*a* and is provided with a delivery valve 6, and housing member 2*c* which blocks the opening end of the housing member 2*b*. The inside of the pump housing 2 is divided into two spaces by a partitioning body 7, i.e., a space into which the drive shaft 3 projects and a space that constitutes the chamber 5 mentioned earlier.

A rotating member 10 projects out into the chamber 5 by passing through the partitioning body 7 with a high degree of oil tightness and its front end is supported by a support member 11, which is fitted into the housing member 2*b*. In other words, a projected portion for fitting 11*a* is formed as part of the support member 11 at its side, and this projected portion for fitting 11*a* is inserted into and fitted in a support member fitting portion 12 which is formed in the housing member 2*b* and secured. The front end of the rotating member 10 is supported at an insertion portion 11*b* formed in the projected portion for fitting 11*a* with a high degree of oil tightness in such a manner that it can rotate freely. The bottom end of the rotating member 10 is linked to the drive shaft 3 via a coupling 13. Consequently, the rotating member 10 can rotate only with the rotation of the drive shaft 3.

Figure 2:
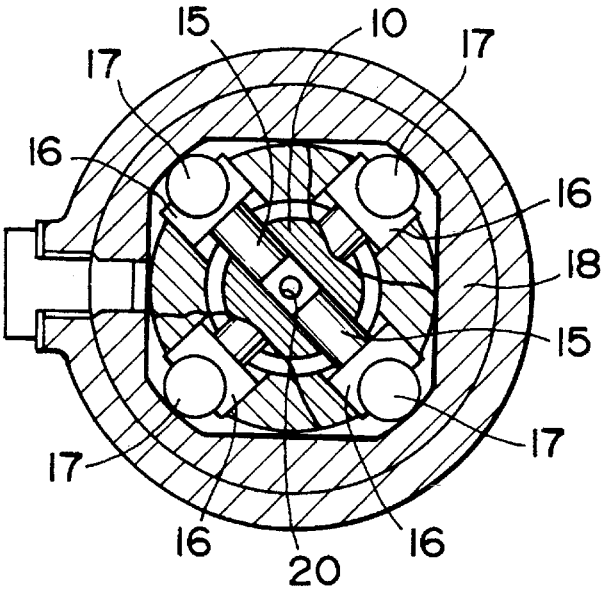
FIG. 2 is a cross section of the cam ring shown in FIG. 1 and the members on its inside, viewed along the direction of the axis of the rotating member.

At the bottom end of the rotating member 10, plungers 15, which can move in the direction of the radius (radial direction), are inserted in such a manner that they face a compression space 19. In this embodiment, as shown in FIG. 2, there are two sets of plungers 15 with their phases at 90° to each other, each set having two plungers 15 facing opposite each other with their phases at 180° to each other in the direction of the axis of the rotating member 10. The two sets of plungers 15, which move reciprocally in the direction of their axes, slide against a ring-like common cam ring 18 via shoes 16 and rollers 17. The cam ring 18 is provided concentrically to, and on the circumference of the rotating member 10 and is secured to the housing member 2*a*. 0n its internal surface, cam surfaces arc formed, the number of which corresponds to the number of cylinders in the engine. For instance, in order to correspond to four cylinders, a projected surface is formed every 90° on the inside of the cam ring 18. Consequently, the four plungers 15 move together to constrict the compression space 19 for compression, and they also move away from the center together.

Figure 5A:
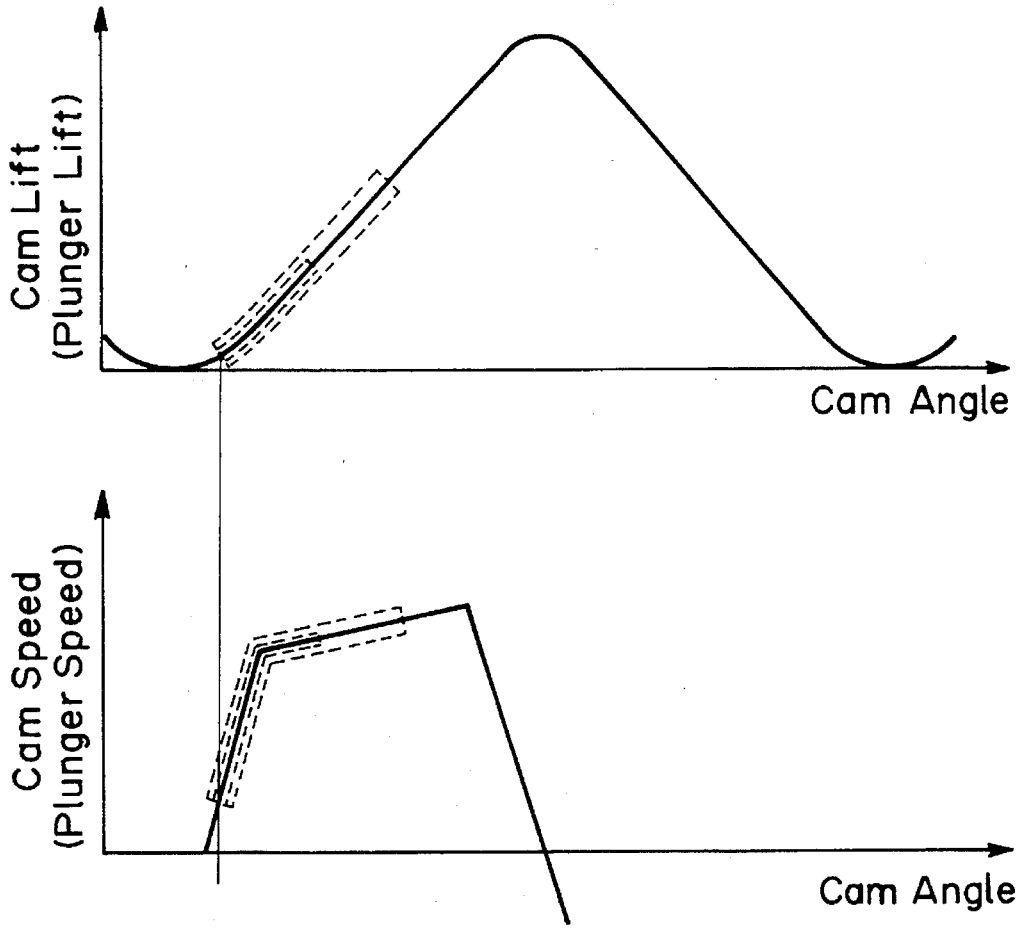
FIG. 5A shows changes in the cam lift and the cam speed in the area of engagement when the position of the first sleeve is changed.

As shown in FIG. 5A, this cam ring 18 has cam speed characteristics such that the cam speed continuously increases until it reaches a specific cam angle and, in particular, while the cam lift is small, the change in cam speed is large in comparison to the period over which the cam lift is large.

To look at FIGS. 1 and 2 again, a longitudinal hole 20, which communicates with the compression space 19 is formed in the rotating member 10 in the direction of its axis. Connected to this longitudinal hole 20 are an intake port 21, which opens into the circumferential surface of the rotating member 10 in the space that constitutes the chamber 5, a cutoff port 22 provided at a position further away from the compression space 19 compared with the intake port 21 and which opens into the circumferential surface of the rotating member 10 in the space that constitutes the chamber 5, and a distribution port 24, which opens into the circumferential surface of the rotating member 10 in the area where the rotating member 10 is inserted into the support member 11 and which can communicate with a distribution passage 23, which communicates with the delivery valve 6.

In addition, a first sleeve 25 and a second sleeve 26 are both fitted externally on the rotating member 10 between the partitioning body 7 and the support member 11, i.e., in the space that constitutes the chamber 5, in such a manner that they can slide freely.

The first sleeve 25 is mounted covering the cutoff port 22 and a cutoff hole 27 formed in the direction of the radius, which makes possible communication between the cutoff port 22 and the chamber 5. The cutoff port and the cutoff hole 27 are both formed as slits which extend in the direction of the axis of the rotating member 10 parallel to each other. This ensures that play in the direction of the axis will not cause a deviation in the timing with which the cutoff port 22 and the cutoff hole 27 communicate with each other. In addition, an electronic governor 28 is linked to the first sleeve 25.

Figure 3A:
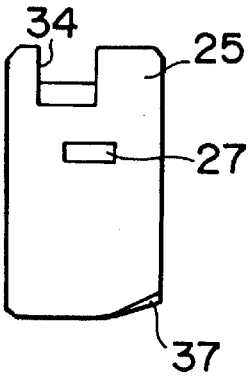
FIG. 3A shows the side surface of the first sleeve and FIG. 3B is a development elevation of the first sleeve.

The electronic governor 28 is positioned in a governor storage chamber 30 which is partitioned by a governor housing 29, mounted on the housing member **2*a*, in such a manner that it communicates with the chamber 5. A shaft 32, which is attached to a rotor 31 that rotates by a signal from the outside, projects out into the chamber 5 and a ball 33 provided at the front end of the shaft 32 connects to a connecting groove 34 which is formed in the first sleeve 25. The ball 33 is provided by decentering from the shaft 32 and when the rotor 31 rotates, the first sleeve 25 moves in the direction of the axis of the rotating member 10. The connecting groove 34 formed in the sieve 25 is formed, as shown in FIGS. 3A and 3**B, over a specific angular range in the direction of the circumference.

Figure 3B:
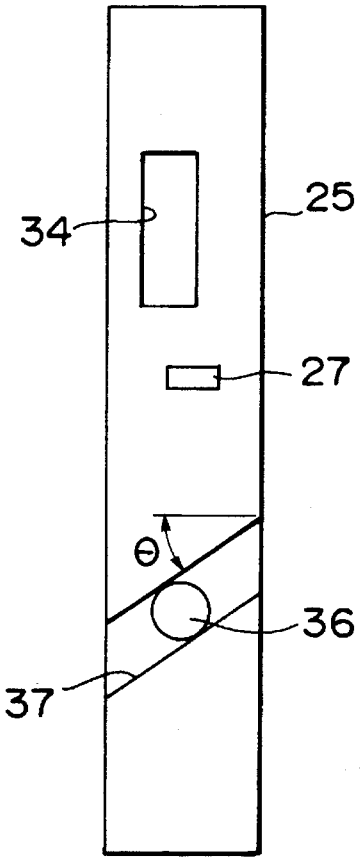

The second sleeve 26, on the other hand, is mounted so as to cover the intake port 21 and an intake hole 35 formed in the direction of the radius, which makes it possible for the intake port 21 and the chamber 5 to communicate. The second sleeve 26 is provided with a projected tab **26*a* which faces opposite the circumferential surface of the first sleeve 25 and a holding pin 36, which is secured to the projected tab 26*a* and is connected to and held in a diagonal lead groove 37 formed in the first sleeve to mechanically regulate the phase relationship between the second sleeve 26 and the first sleeve 25. The diagonal lead groove 37, as shown in FIG. 3B, is formed on the circumferential surface of the first sleeve 25 at a specific angle to the direction of the axis ($0°<\theta<90°$), and the holding pin 36 is connected and held in the diagonal lead groove 37 without any play. A timer mechanism 40 is linked to the second sleeve 26**.

The timer mechanism 40 in this embodiment is provided with a timer piston 42 which is stored in a cylinder 41 provided below the second sleeve 26 in such a manner that it can slide freely. The timer piston 42 and the second sleeve 26 are connected via a lever 43. By moving the timer piston 42, the second sleeve 26 is rotated to change the timing with which the intake port 21 and the intake hole 35 communicate with each other, which, in turn, changes the injection timing.

At one end of the timer piston 42, a high pressure chamber is provided, into which the high pressure fuel inside the chamber is induced, and at the other end, a low pressure chamber is provided, which communicates with the intake path of the feed pump 4. Furthermore, a timer spring is provided in the low pressure chamber and the timer spring applies a constant force to the timer piston 42 toward the high pressure chamber. As a result, the timer piston 42 stops at a position where the spring pressure from the timer spring and the hydraulic pressure inside the high pressure chamber are in balance. When the pressure in the high pressure chamber becomes high, the timer piston 42 moves toward the low pressure chamber in resistance to the force from the timer spring, and the second sleeve 26 is rotated in the direction in which the injection timing is hastened, to advance the injection timing. In contrast, when the pressure in the high pressure chamber becomes low, the timer piston 42 moves toward the high pressure chamber, and the second sleeve 26 is rotated in the direction in which the injection timing is delayed, to retard the injection timing.

The pressure in the high pressure chamber of the timer is adjusted with a timing control valve (TCV), 45 so that the desired timer advance angle can be achieved. The timing control valve 45 is provided with an entrance portion which communicates with both the chamber 5 and the high pressure chamber at its side and an exit portion which communicates with the low pressure chamber at the front end. Inside the timing control valve 45, a needle 46, which opens and closes between the entrance portion and the exit portion, is housed. The needle 46 is constantly subject to a force from a spring which works in the direction in which the communication between the entrance portion and the exit portion is cut off. When power runs to a solenoid 47, the needle is pulled in resistance to the spring, and the entrance portion and the exit portion come into communication, causing the high pressure chamber and the low pressure chamber to communicate.

In summary, when there is no electric current running to the solenoid 47, the high pressure chamber and the low pressure chamber are completely cut off from each other. When a current is running to the solenoid 47, the high pressure chamber and the low pressure chamber are in communication to lower the pressure in the high pressure chamber. As the pressure in the high pressure chamber becomes lowered, the timer piston 42 moves to the position where it is in balance with the spring force of the timer spring, which, in turn, causes the second sleeve 26 to rotate, changing the injection timing. Note that it is advisable to control the timing control valve 45 through duty ratio control.

Figure 4A:
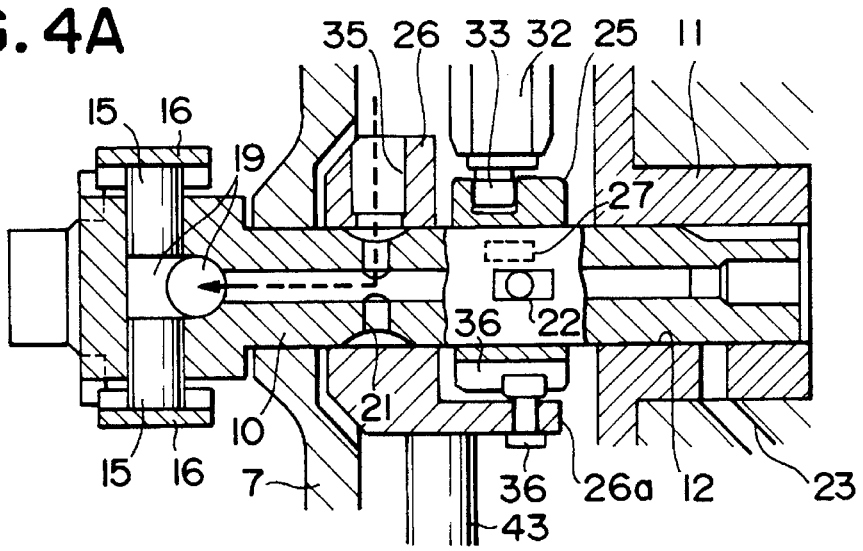
FIG. 4A illustrates the intake process.

In the structure described above, when the rotating member 10 rotates, the cam ring 18 causes the plungers 15 to move reciprocally in the direction of the radius of the rotating member 10. During the intake process, in which the plungers 15 move away from the center of the cam ring 18, the intake port 21 and the intake hole 35 become aligned and fuel is taken into the compression space 19 from the chamber 5 (FIG. 4A).

Figure 4B:
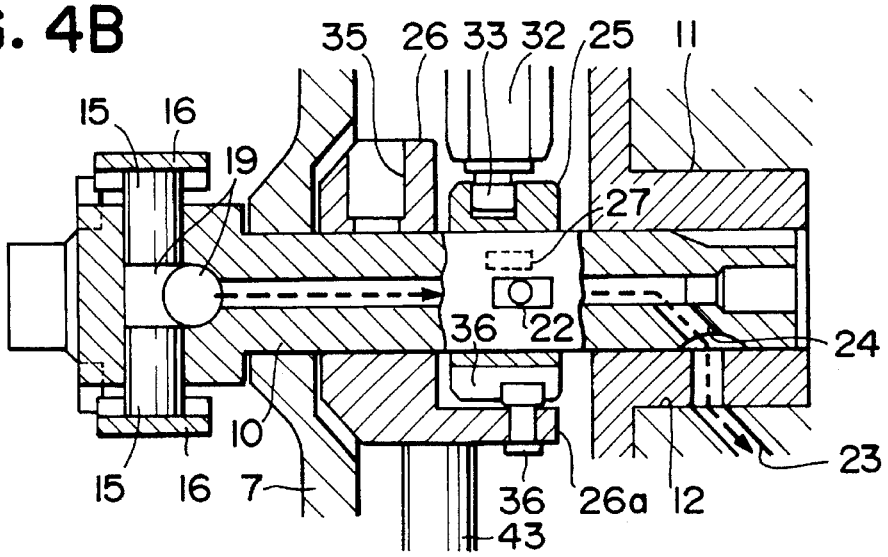
FIG. 4B illustrates the force feed process and FIG. 4C illustrates the injection end.

Then, when the operation enters the force feed process, in which the plungers 15 move toward the center of the cam ring 18, the communication between the intake port 21 and the intake hole 35 is cut off, and the distribution port 24 and one of the distribution passages 23 become aligned to supply compressed fuel to the delivery valve via the distribution passage 23 (FIG. 4B). Note that the fuel sent out through the delivery valve 6 is supplied to an injection nozzle via an injection pipe (not shown) and is then injected into a cylinder of the engine from the injection nozzle.

Figure 4C:
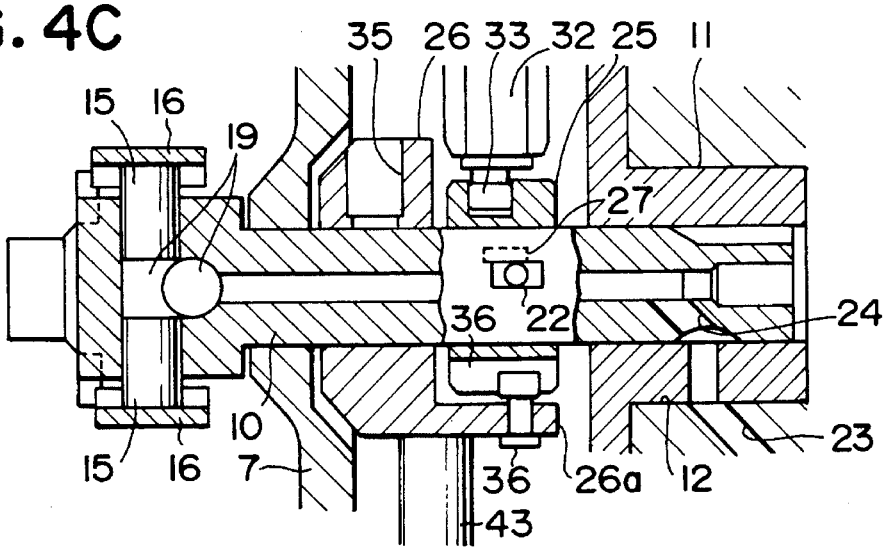

After that, when the cutoff port 22 and the cutoff hole 27 align and the cutoff port 22 opens into the chamber 5 in the middle of the force feed process, the compressed fuel flows out into the chamber 5 to stop fuel delivery to the injection nozzle and end the injection (FIG. 4C). Consequently, the angle of rotation, starting from the point when communication between the intake port 21 and the intake hole 35 is cut off until the point when the cutoff port 22 and cutoff hole 27 are in communication, is the force feed effective angle (force feed effective stroke).

Since the timing with which the cutoff port 22 and the cutoff hole 27 become aligned can be varied depending upon the position of the first sleeve 25, the injection end, i.e., the injection quantity, can be controlled through positional adjustment of the first sleeve 25. In other words, as the first sleeve 25 is moved to the left in the figure, (toward the base end of the rotating member 10) the injection quantity decreases, and as it is moved toward the right (toward the front end of the rotating member 10) the injection quantity increases.

Figure 5B:
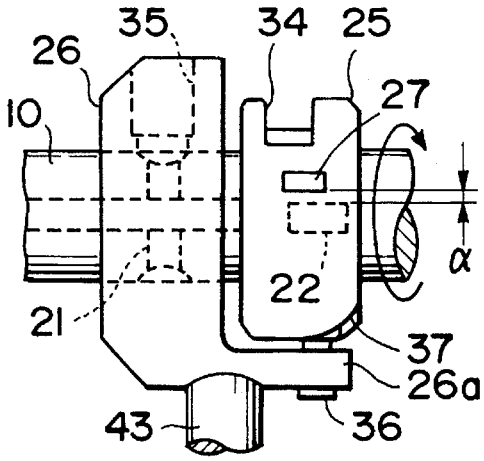
FIG. 5B shows the positional relationship between the first and second sleeves when the injection quantity is small and FIG. 5C shows the positional relationship between the first and second sleeves when the injection quantity is large.
Figure 5C:
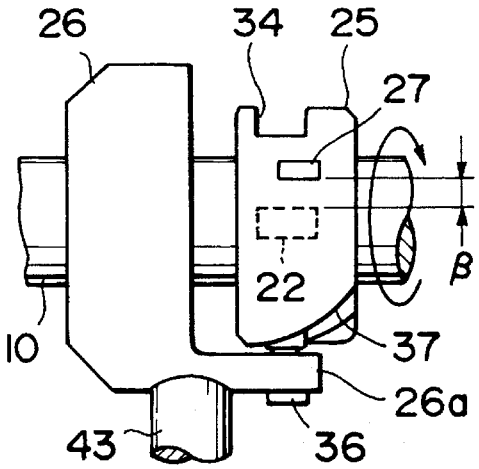

To give a more detailed explanation; when the positional relationship between the first sleeve 25 and the second sleeve 26 is as shown in FIG. 5B, if the first sleeve 25 is moved to the right in the figure (in the direction in which fuel increases) to achieve the state shown in FIG. 5C, the position at which the holding pin 36 and the diagonal lead groove 37 are connected and held becomes offset, and the first sleeve 25 moves in the direction of the axis of the rotating member while rotating in the direction of the circumference. Since there is no change in the timing with which the intake port 21 and the intake hole 35 communicate with each other, the force feed start does not change in either case. However, since the timing with which the cutoff port 22 and the cutoff hole 27 communicate with each other is delayed, the force feed effective angle changes from $\alpha$ to $\beta$, which is larger than a and, as shown in FIG. 5A, the area over which the cam surface is engaged during the force feed process becomes expanded to increase the injection quantity.

In contrast, when the positional relationship between the first sleeve 25 and the second sleeve 26 is as shown in FIG. 5C, if the first sleeve 25 is moved to the left in the figure to achieve the state shown in FIG. 5B, the first sleeve is rotated in the direction in which the force feed effective angle is reduced, to advance the timing with which the cutoff port 22 and the cutoff hole 27 communicate with each other, which reduces the area over which the cam surface is engaged during the force feed process, reducing the injection quantity.

in addition, the timing with which the intake port 21 and intake hole 35 become aligned with each other can be varied by the timer mechanism 40. Therefore, the injection start, i.e., the pre-stroke quantity, can be controlled through the positional adjustment of the timer piston 42.

Figure 6A:
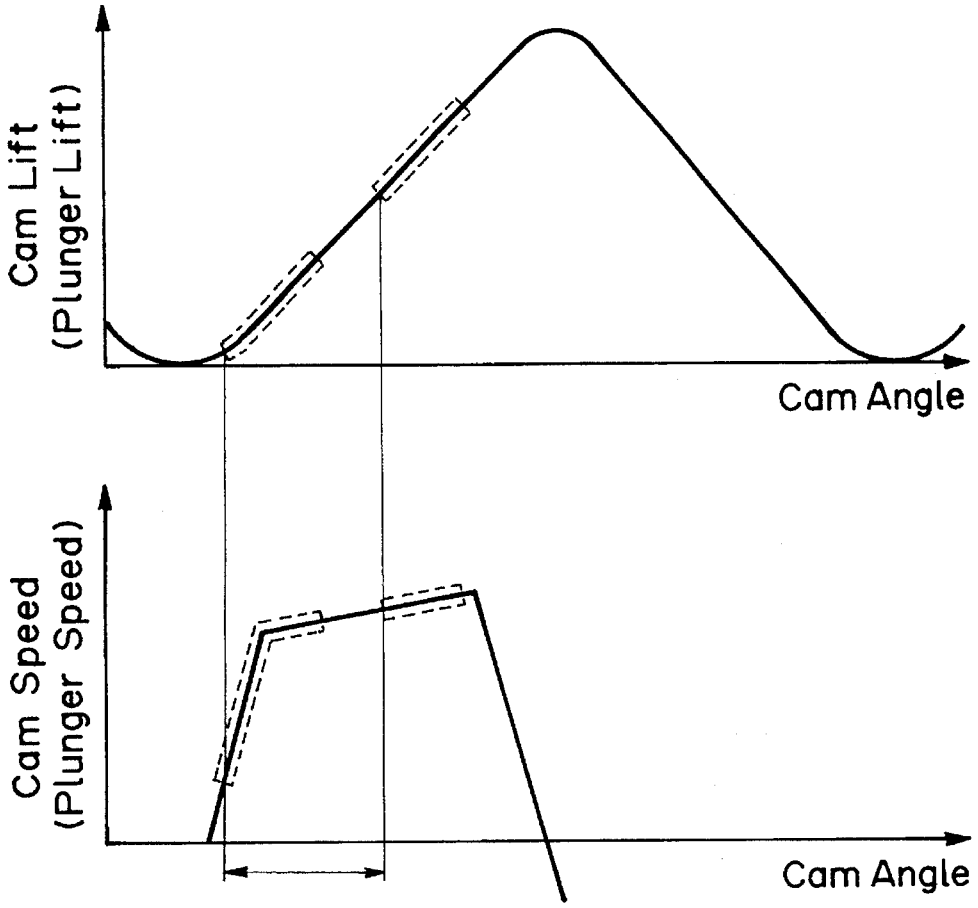
FIG. 6A shows changes in the cam lift and the cam speed in the area of engagement when the position of the second sleeve is changed.
Figure 6B:
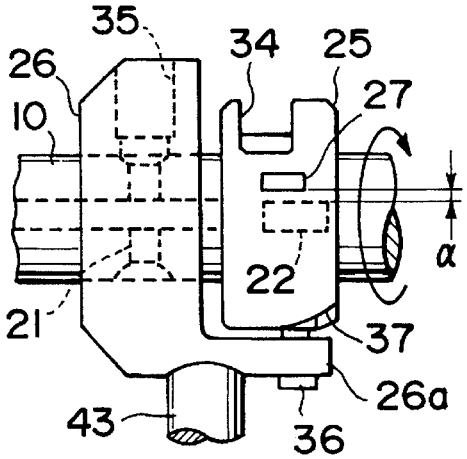
FIG. 6B shows the positional relationship between the first and second sleeves when the injection timing is advanced and FIG. 6C shows the positional relationship between the first and second sleeves when the injection timing is delayed.

To give a more specific explanation of this; when the positional relationship between the first sleeve 25 and the second sleeve 26 is as shown in FIG. 6B, if the timer piston 41 moves to rotate the second sleeve 26 in the direction in which the injection timing is delayed, as shown in FIG. 6, the first sleeve 26, too, is rotated by the same angle in the same direction as the second sleeve 26. In other words, while the force feed effective angle is unchanged at $\alpha$ since the cam ring 18 is fixed in the housing 2, the area over which the cam ring 18 is engaged during the force feed process shifts into the high speed area, as shown in FIG. 6A, and the timing with which the intake port 21 and the intake hole 35 communicate, and the timing with which the cutoff port 22 and the cutoff hole 27 communicate, are delayed simultaneously. As a result, while the injection quantity changes somewhat, the overall injection timing becomes delayed.

Figure 6C:
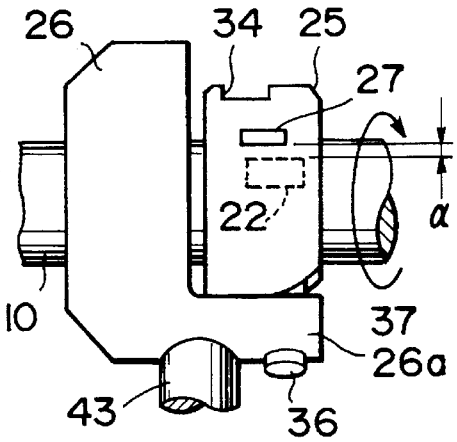

In contrast, when the positional relationship between the first sleeve 25 and the second sleeve 26 is as shown in FIG. 6C, if the timer piston 41 moves to rotate the second sleeve 26 in the direction in which the injection timing is advanced, as shown in FIG. 6B, the first sleeve 26, too, is rotated by the same angle in the same direction as the second sleeve 26, i.e., to advance the timing. The area over which the cam ring 18 is engaged during the force feed process shifts into the low speed area and the timing with which the intake port 21 and the intake hole 35 communicate and the timing with which the cutoff port 22 and the cutoff hole 27 communicate are advanced simultaneously to hasten the injection timing.

As has been explained, since the timer mechanism 40 is connected to the second sleeve 26 with the cam ring 18 fixed in the housing 2, the drive reaction force during the force feed process does not work on the timer mechanism 40 via the cam ring 18, ensuring accurate movement of the timer mechanism 40 and, at the same time, maintaining stable injection timing control, thereby improving the accuracy of control.

Furthermore, since the cutoff port 22 and the cutoff hole 27 are formed parallel to each other in the direction of the axis of the rotating member 10, even if there is play in the rotating member 10 in the direction of the axis, it will not change the force feed start and the force feed end to cause a deviation in the injection characteristics. Consequently, injection accuracy is improved without having to improve the accuracy of assembly of the rotating member 10 in the direction of the axis.

Another point to add here is that the pump housing 2 is partitioned inside by the partitioning body 7 into a lo pressure side fuel path, which is filled with 1o pressure, low temperature fuel, and a high pressure side fuel path, which is filled with fuel that has been compressed by the feed pump 4 and is maintained at a relatively high pressure. Also, the cam ring 18, the rollers 17 and the shoes 16 are all provided in the low pressure side fuel path. As a result, cooling of the contact area of the cam ring 18 with the rollers 17 and the contact area of the rollers 17 with the shoes 16, which are subject to friction heat as the rotating member 10 rotates, is promoted. Also, lubrication in the vicinity of the rollers is promoted to ensure smooth movement.

Moreover, since the second sleeve 26 is connected and held in the diagonal lead groove 37 of the first sleeve 25, the injection timing and the force feed effective angle can be controlled independently of each other. In other words, in a state in which the first sleeve and the second sleeve are not interlocked, when the injection timing is changed, the force feed effective angle also changes. In order to correct this, it is necessary to correct the position of the first sleeve by detecting the movement of the second sleeve with a sensor or the like. Thus, control of one must take into account the movement of the other. However, according to the present invention, since the first sleeve interlocks with the movement of the second sleeve, the force feed effective angle is not affected by the timer control, and when the force feed effective angle is to be changed, the first sleeve is controlled independently.

As has been explained, according to the present invention, since the cam ring is fixed in the pump housing, and the second sleeve, which is linked to the timer to adjust the injection timing is made to interlock with the first sleeve in a specific relationship for adjusting the fuel injection quantity, the control operation by the timer is not disrupted by the load during the force feed process and stable injection timing can be achieved.

In addition, with the adjustment of timing in which the cutoff port opens being implemented by forming a cutoff hole in the first sleeve and the cutoff port and the cutoff hole being constituted of slits extending in the direction of the axis of the rotating member, even if the rotating member has play in the direction of the axis, the accuracy with which injection control is performed can be improved with no change in the injection timing or the force feed effective angle.

Furthermore, with the structure in which a diagonal lead groove is formed in the first sleeve at a specific angle to the direction of the axis, with the second sleeve being connected and held in the diagonal lead groove, the injection timing and the force feed effective angle can be controlled through positional control of the sleeve by connecting and holding the second sleeve in the diagonal lead groove formed in the first sleeve and, at the same time, since the first sleeve and the second sleeve move by interlocking with each other in a specific relationship, it is not necessary to perform correction by incorporating the control of one into the control of the other, achieving independence of the controls.

What is claimed is:

1. A distributor-type fuel injection pump comprising;

a rotating member that rotates in synchronization with an engine and is provided with a compression space, and with an intake port, a distribution port and a cutoff port formed to communicate with said compression space, plungers provided in the direction of the radius of said rotating member, which change the volumetric capacity of said compression space formed at said rotating member, a cam ring provided concentrically to, and on the circumference of said rotating member, which regulates the movement of said plungers, a housing, which houses said rotating member, said plungers and said cam ring, with said cam ring being fixed to said housing, a first sleeve that is externally fitted on said rotating member in such a manner that it can slide freely, to adjust the timing with which said cutoff port is opened, a second sleeve that is externally fitted on said rotating member in such a manner that it can slide freely, to regulate the timing with which said intake port is opened, a means for interlocking said first sleeve and said second sleeve in a specific relationship, and a means for adjusting the quantity of rotation of said second sleeve in the direction of the circumference with a timer mechanism by linking said timer mechanism to said second sleeve.

2. A distributor-type fuel injection pump according to claim 1 wherein;

a cutoff hole which can communicate with said cutoff port is formed in said first sleeve, with said cutoff port and said cutoff hole being formed as slits extending in the direction of the axis of said rotating member.

3. A distributor-type fuel injection pump according to claim 1 wherein;

said means for interlocking said first sieve and said second sleeve is constituted by forming a diagonal lead groove in said first sleeve at a specific angle to the direction of the axis and by connecting and holding said second sleeve in said diagonal lead groove.

4. A distributor-type fuel injection pump according to claim 3 wherein;

an intake hole which can communicate with said intake port and a projected tab which faces opposite the circumferential surface of said first sleeve are provided in the second sleeve, and a connecting and holding pin, secured at said projected tab, is connected and held in said diagonal lead groove formed in said first sleeve.

5. A distributor-type fuel injection pump according to claim 1 wherein;

the timing with which fuel is cut off by said first sleeve is adjusted by moving said first sleeve in the direction of the axis of said rotating member.

6. A distributor-type fuel injection pump according to claim 1 wherein;

said housing is partitioned by a partitioning body into a space where said plungers and said cam ring are provided and a space which can communicate with said intake port and said cutoff port.

7. A distributor-type fuel injection pump according to claim 1 wherein;

two sets of said plungers are provided, each set having two plungers facing opposite each other whose phases are different by 180°, said sets being offset in the direction of the axis of said rotating member with their phases different by 90°.

* * * * *